United States Patent [19]

Dietz et al.

[11] Patent Number: 4,922,355

[45] Date of Patent: May 1, 1990

[54] ILLUMINATED BEVERAGE VESSEL

[76] Inventors: M. David Dietz, 9 Dogwood La., Westport, Conn. 06880; Nathaniel Silver, 55 Glendale Rd., Glenbrook, Conn. 06906

[21] Appl. No.: 361,339

[22] Filed: Jun. 5, 1989

[51] Int. Cl.[5] ..... F21V 33/00; F21V 23/00

[52] U.S. Cl. ..... 362/101; 362/276; 362/802

[58] Field of Search ..... 362/96, 101, 154, 802, 362/276

[56] References Cited

U.S. PATENT DOCUMENTS

| | | | |
|---|---|---|---|
| 2,532,181 | 11/1950 | Moore | 362/101 |
| 2,663,866 | 12/1953 | Simpson | 362/101 |
| 4,234,819 | 11/1980 | Maxey | 362/802 X |
| 4,344,113 | 8/1982 | Ditto et al. | 362/101 |
| 4,390,928 | 6/1983 | Runge | 362/802 X |
| 4,754,379 | 6/1988 | Kelley | 362/101 X |

FOREIGN PATENT DOCUMENTS

| | | | |
|---|---|---|---|
| 2465154 | 4/1981 | France | 362/101 |

*Primary Examiner*—Ira S. Lazarus
*Assistant Examiner*—Peggy A. Neils

[57] ABSTRACT

A two compartment vessel has an upper compartment for containing a liquid and a lower compartment for containing an electrical circuit including a lamp. A light transmitting wall separates the two compartments. A set of spaced electrical contacts disposed on the vessel are connected to the electrical circuit. Responsive to the lowering of the electrical impedance between the contacts as caused by moisture bridging the gap between the contacts, the lamp is actuated to shine light into the upper compartment. In one embodiment, the contacts are disposed on the light transparent wall for causing activation of the lamp responsive to the electrical conductivity of the liquid in the upper compartment. In another embodiment the set of contacts is disposed on the handle forming a part of the container, and actuation of the lamp is responsive to moisture at the surface of the skin of the user grasping the handle whereby a lowering of the electrical impedance between the contacts occurs.

6 Claims, 1 Drawing Sheet

ILLUMINATED BEVERAGE VESSEL

BACKGROUND OF THE INVENTION

This invention concerns an illuminated beverage vessel in which the liquid content of the vessel is illuminated. Vessels of this type are known, having been described, for instance, in the following prior art patents:

| U.S. Pat. No. | Date of Issue | Inventor |
|---|---|---|
| 2,177,337 | Oct. 24, 1939 | A. Stein |
| 2,532,181 | Nov. 28, 1950 | M. E. Moore |
| 2,745,947 | May 15, 1956 | J. L. Sansous |
| 3,374,344 | Mar. 19, 1968 | R. H. Rudolph et al |
| 3,878,386 | Apr. 15, 1975 | D. Douglas |

These prior art devices employ a mechanical switch for causing the illumination to be turned on or off. The switch may be mounted for manual operation, or may be mounted to a holder into which the vessel is placed whereby the switch is actuated responsive to the vessel being disposed in the holder. In another prior art device, the mechanical switch is mounted to the underside of the vessel and operated responsive to the vessel being placed upon a flat supporting surface, such as a table.

SUMMARY OF THE INVENTION

The present invention concerns an illuminated beverage vessel in which the illumination is effected automatically responsive to a lowering of the electrical impedance between a set of spaced electrical sensors or contacts disposed on the vessel. The change in impedance may result from a liquid in the vessel or by grasping the handle of the vessel. For a change in impedance resulting from a liquid disposed in the vessel, a set of electrical contacts is located in the vessel. Hence, the illumination will automatically cease when the vessel is empty. In the alternative construction, a set of spaced electrical contacts is disposed on the handle and the illumination is on during the time in which the moisture on the skin of the palm or fingers of the user lowers the electrical impedance existing between the set of contacts. An electrical circuit provides means for adjusting the sensitivity of the electrical circuit, i.e. the point at which the illumination occurs.

In this manner, an illuminated beverage vessel is provided in which the illumination of the beverage occurs automatically in response to a change of the electrical impedance between a set of electrical contacts, thus obviating the need for a mechanical switching device operated manually or responsive to placing the vessel on a surface or into a specific holder.

One of the important objects of this invention, therefore, is the provision of a new and improved illuminated beverage vessel.

Another important object of this invention is the provision of a new and improved illuminated beverage vessel in which the illumination is responsive to a change in the electrical impedance between a set of contacts.

Another important object of this invention is the provision of an illuminated beverage vessel incorporating a pair of electrical contacts for actuating the illumination of the liquid, such set of contacts being either disposed for contact by the liquid, or being disposed outside the liquid, such as a handle of the vessel for being contacted by the hand of the user of the vessel.

Still other objects of the invention will readily be apparent when reading the following description in conjunction with the accompanying drawing.

DETAILED DESCRIPTION OF THE INVENTION

Figure 1:
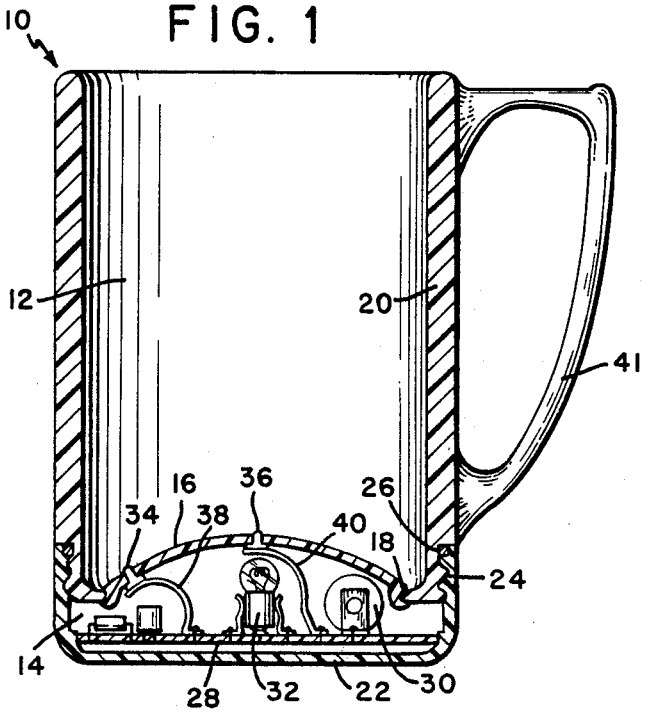
FIG. 1 is an elevational view, partly in section of a preferred embodiment of the invention.

Referring now to the figures and FIG. 1 in particular, numeral 10 designates a two-compartment vessel comprising a first compartment 12 for holding a liquid and a second compartment 14 for holding an electrical circuit including illumination means. The compartments are separated by a domed wall 16 which is secured at its circumference to a lip 18 of an open ended cylinder 20. In this manner, the cylinder 20 and wall 16 form a vessel for containing a liquid. The cylinder 20 may be made from plastic or ceramic material or glass. The domed wall 16 forming the bottom of the compartment 12, in the preferred embodiment, comprises light transmitting plastic material having a relatively low surface retention for liquids, such as polypropylene. For good visual effects, the cylinder 20 may also be light transparent. The lower compartment 14, serving as base, is formed by a cup-shaped plastic container 22 which is secured to the cylinder 20 by thread means 24 and an O-ring gasket 26. It will be apparent that the lower end of the cylinder 20 and the upper end of the container 22 are provided with complementary threads to effect threaded engagement.

The second and lower compartment 14 is provided with an electrical circuit board 28 containing various electrical circuit components, among which are a battery 30 and illumination means, such as a lamp 32. The domed surface 16 is provided with a pair of spaced electrical contacts 34 and 36, electrically insulated from one another, and connected electrically by contact springs 38 and 40 to the circuit board 28 carrying the electrical circuit for causing the lamp 32 to become connected to the battery 30.

As shown, the lower compartment can be detached from the upper compartment by unscrewing the container 22, as may be required for replacing the battery or the lamp or as for cleaning the upper liquid receiving compartment by running it through an automatic dishwasher machine.

For convenience, the cylinder 20 is also provided with a handle 41.

Operation of the present device can be visualized as follows: The electrical circuit is adjusted to cause the lamp 32 to be de-energized when the electrical impedance between contacts 34 and 36 indicates a "high" value, that is, absence of a liquid or moisture. When the upper compartment is filled with a liquid, the impedance between contacts 34 and 36 is lowered by the electrical conductivity of the liquid, and, hence, the electrical circuit will cause energizing of the lamp 32, which then emits light which penetrates through the wall 16 and illuminates the upper compartment and the liquid or beverage therein.

Contact 36 is disposed at the apex of the domed wall 16 for causing this contact to become uncovered by the liquid as soon as the compartment becomes nearly empty. The use of a plastic material having a low surface retention for liquids contributes to the electrical impedance between the contacts 34 and 36 being restored quickly to a "high" condition for extinguishing the lamp 32 when the compartment is substantially empty. The contact 34 is disposed at the lower end of the wall 16.

Figure 3:
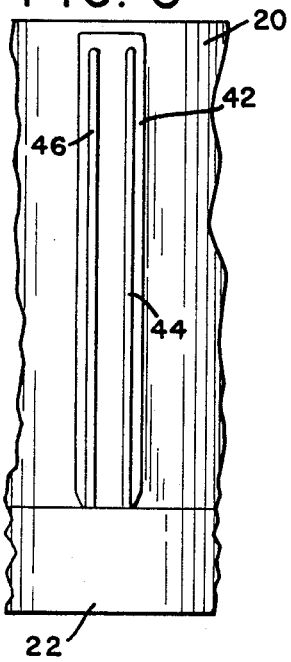
FIG. 3 is a detail view of the handle shown in FIG. 2.
Figure 2:
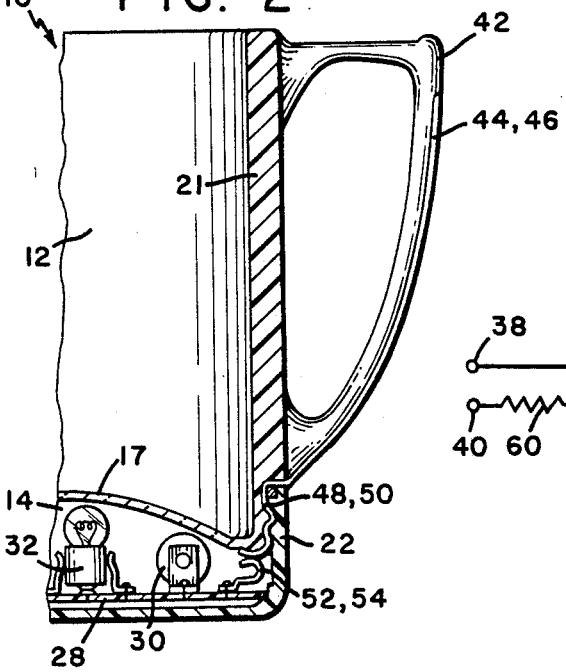
FIG. 2 is an elevational view, partly in section, of an alternative construction of the invention.

An alternative construction is shown in FIGS. 2 and 3. Instead of providing the electrical contacts for contact by a liquid in the compartment, the contacts 44 and 46 are provided on the handle 42. In a typical example, the contacts 44 and 46 are strips of silver or copper metal, silk-screened or otherwise affixed to the surface of the handle 42 made of electrically non-conductive material, such as plastic material. The strips 44 and 46 are connected to respective electrically conductive strips 48 and 50 at the threaded portion of the cylinder 21 and then contacted by spring contacts 52 and 54 connected to the electrical circuit board 28. The cylinder 21 and the light transmitting wall 17 forming the bottom of the upper or first compartment 12 may be molded as a unitary assembly, see FIG. 2.

As described above, absent any moisture or liquid, the electrical impedance between contacts 44 and 46 will be at a first, "high" value. Responsive to the handle being grasped by a person, the electrical impedance will be reduced to a second, lower value due to the moisture present at the skin of the hand of the user bridging the gap between the contacts. This reduction of impedance will cause energizing of the lamp 32. When the vessel 10 is set down and the hand removed from the handle 42, the impedance returns to a high value and the lamp is extinguished.

Hence, as in the earlier described embodiment, the illumination of the liquid in the upper compartment 12 is responsive to the presence of moisture or liquid acting upon the set of electrical contacts provided on the vessel 10. In the absence of moisture, the lamp 32 will be dark. The handle 42, preferably is made from material having a relatively low surface retention for liquids as described in connection with the wall 16.

Since different liquids have different electrical conductivity, the electrical circuit can include means for adjusting the sensitivity of the circuit, that is, selecting the impedance at which circuit activation occurs. In this manner, the circuit can be adjusted to be responsive to selected liquids.

In another embodiment, the contact 36 may be disposed as shown in FIG. 1 on the light transmitting wall 16, while the other contact 34 could be placed on the lip of the cylinder 20 or upon the wall of the cylinder 20.

Figure 4:
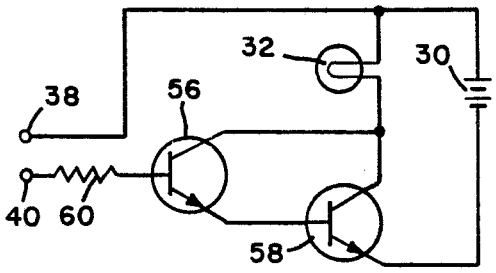
FIG. 4 is a schematic electrical circuit diagram for operating the illumination provided in the vessel.

FIG. 4 shows a typical electrical circuit usable for the present application. Contact springs 38 and 40 are connected respectively to contacts 34 and 36. Upon moisture bridging the gap between contacts 34 and 36 an electrical current flows from the battery 30 to the contacts 34 and 36 and to contact springs 38 and 40 for turning on transistor 56. Current then will flow to the base of transistor 58, rendering this transistor conductive to thereby cause current flow from the battery 30 through the lamp 32. When the current flow between contacts 34 and 36 ceases, high impedance between the contacts is restored and the lamp 32 becomes extinguished. Resistor 60 can be made variable to change the sensitivity of the circuit, that is the point at which the lamp is activated.

While there has been described and illustrated a preferred embodiment of the invention together with certain modifications, it will be apparent to those skilled in the art that various further changes and modifications may be made without deviating from the broad principle of this invention, which shall be limited only by the scope of the appended claims.

What is claimed is:

1. An illuminated beverage vessel comprising:
a first compartment for holding a liquid;
a second compartment disposed below said first compartment and containing a lamp and an electrical battery generated circuit for energizing said lamp;
a light transmitting wall separating said first compartment from said second compartment and forming the bottom of said first compartment;
a pair of electrical contacts electrically insulated from one another disposed in said first compartment for being contacted by liquid disposed in said first compartment, and
further contact means disposed for coupling said pair of electrical contacts to said electrical circuit for causing said electrical circuit to energize said lamp for transmitting light through said wall into said first compartment responsive to liquid in said first compartment bridging the insulation between said pair of contacts and thereby lowering the electrical impedance between said contacts.

2. An illuminated beverage vessel as set forth in claim 1, said light transmitting wall comprising material having a relatively low surface retention for the liquid in said first compartment.

3. An illuminated beverage vessel as set forth in claim 2, said light transmitting wall being domed and including at least one of said pair of electrical contacts.

4. An illuminated beverage vessel as set forth in claim 1, said further contact means including contact springs.

5. An illuminated beverage vessel as set forth in claim 1, said second compartment being removably attached to said first compartment.

6. An illuminated beverage vessel comprising:
a first compartment for holding a liquid;
a second compartment disposed below said first compartment and containing a lamp and an electrical battery operated circuit for energizing said lamp;
a light transmitting wall separating said first compartment from said second compartment and forming the bottom of said first compartment;
a handle disposed for manually supporting said first and second compartments;
a pair of electrical contact strips electrically insulated from one another disposed on said handle, and
further contact means disposed for coupling said pair of electrical contacts to said electrical circuit for causing said electrical circuit to energize said lamp for transmitting light through said wall into said first compartment responsive to moisture bridging the insulation between said pair of contacts and thereby lowering the electrical impedance between said contacts.

* * * * *